US005203530A

United States Patent [19]

Liu

[11] Patent Number: 5,203,530

[45] Date of Patent: Apr. 20, 1993

[54] BALLOON HOLDER

[76] Inventor: Kuang-Pu Liu, No. 31, Cheng-Chao St., Kaohsiung City, Taiwan

[21] Appl. No.: 836,916

[22] Filed: Feb. 19, 1992

[51] Int. Cl.[5] ..... G10F 1/00; A63H 5/00

[52] U.S. Cl. ..... 248/309.1; 446/397

[58] Field of Search ..... 248/309.1, 624, 310, 248/548, 549; 446/220, 222, 223, 297, 397

[56] References Cited

U.S. PATENT DOCUMENTS

| | | | |
|---|---|---|---|
| 2,882,645 | 4/1959 | Stivers | 446/220 |
| 4,589,854 | 5/1986 | Smith | 446/223 |
| 4,704,934 | 11/1987 | Nosrati | 446/220 X |
| 4,737,133 | 4/1988 | Neumeier | 446/397 |
| 4,798,554 | 1/1989 | Nelson et al. | 446/220 X |
| 4,920,674 | 5/1990 | Shaeffer | 446/220 X |
| 5,024,011 | 6/1991 | Collins | 446/220 X |

*Primary Examiner*—Karen J. Chotkowski
*Attorney, Agent, or Firm*—Shlesinger Arkwright & Garvey

[57] ABSTRACT

A balloon holder includes a bracket plate, a shank and a hollow casing made of an insulative material and connected between the bracket plate and the shank. The casing has an electronic music producing device, a spring member and a swinging plate mounted in the casing. The swinging plate is connected between the bracket plate and the spring member. The spring member is connected between the bottom of the casing and the swinging plate so that the swinging plate can swing within the casing. An annular flange extends inwardly from the internal wall of the casing between the swing plate and the electronic music producing device. A first and a second electrically conductive ring are respectively provided on the swinging plate and the annular flange and are respectively and electrically connected to the electronic music producing device. Therefore, the electronic music producing device can be actuated to produce music when the swinging plate is swung to allow the first and second electrically conductive rings to contact.

1 Claim, 3 Drawing Sheets

BALLOON HOLDER

BACKGROUND OF THE INVENTION

1. Field of the Invention

This invention relates to a balloon holder, more particularly to a balloon holder which can produce music when the balloon attached to the balloon holder is swung by a user.

2. Description of the Related Art

Referring to FIG. 1, a conventional balloon holder includes a bracket plate 2 and a shank 3 connected to the bracket plate 2. The bracket plate 2 has two opposed positioning notches 21, 22 formed thereon whereupon the mouth 11 of a balloon 1 is twisted and tied, as best illustrated in FIGS. 2 and 3. Therefore, a balloon 1 can be held by the balloon holder. Children can hold the shank 3 of the balloon holder for playing purposes. However, such a balloon holder cannot provide additional amusing effects.

SUMMARY OF THE INVENTION

It is therefore a main object of this invention to provide a balloon holder which can produce music so as to increase the amusing effects of the balloon holder.

Accordingly, a balloon holder of this invention includes a bracket plate having two notches for positioning a mouth of a balloon, a shank and a hollow casing made of an insulative material and connected between the bracket plate and the shank. The casing has an electronic music producing device, a spring member and a swinging plate mounted therein. The swinging plate is connected between the bracket plate and the spring member. The spring member is connected between the bottom of the casing and the swinging plate so that the swinging plate can swing within the casing. An annular flange extends inwardly from the internal wall of the casing between the swing plate and the electronic music producing device. A first and a second electrically conductive ring are respectively provided on the swinging plate and the annular flange and are respectively and electrically connected to the electronic music producing device. Therefore, the electronic music producing device can be actuated to produce music when the swinging plate is swung to allow the first and second electrically conductive rings to contact.

BRIEF DESCRIPTION OF THE DRAWINGS

Other features and advantages of this invention will become apparent in the following detailed description of the preferred embodiment of this invention with reference to the accompanying drawings, in which.

DETAILED DESCRIPTION OF THE PREFERRED EMBODIMENT

Figure 1:
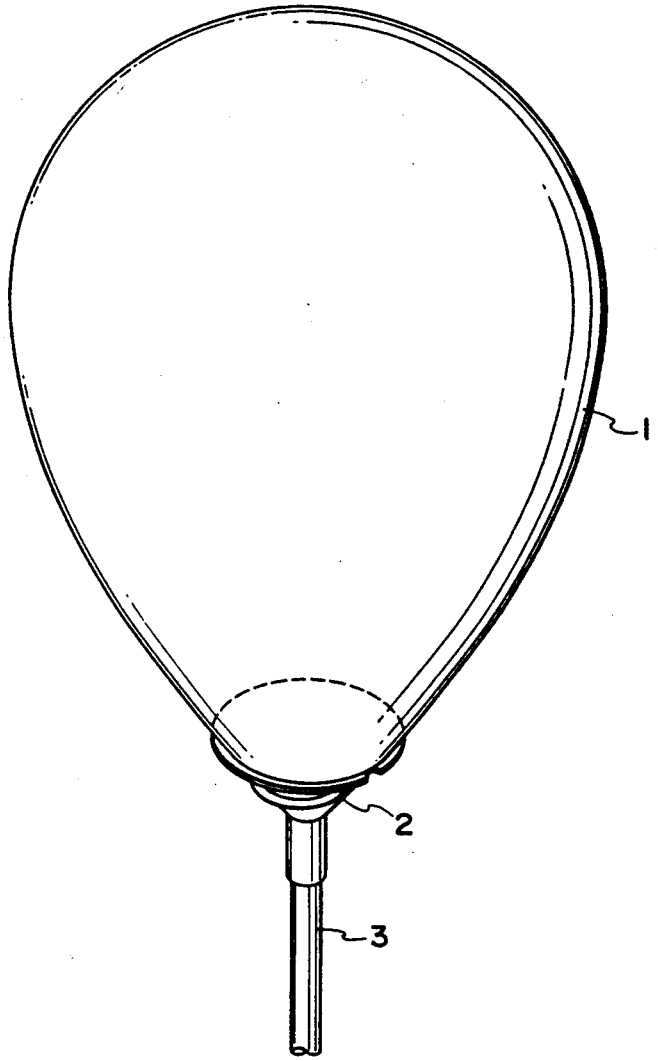
FIG. 1 (PRIOR ART)
FIG. 1 is a perspective view of a conventional balloon holder.
Figure 2:
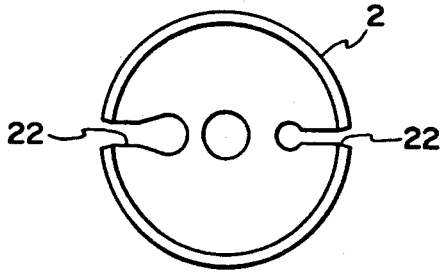
FIG. 2 (PRIOR ART)
FIG. 2 is a plan view of the bracket plate of the conventional balloon holder.
Figure 3:
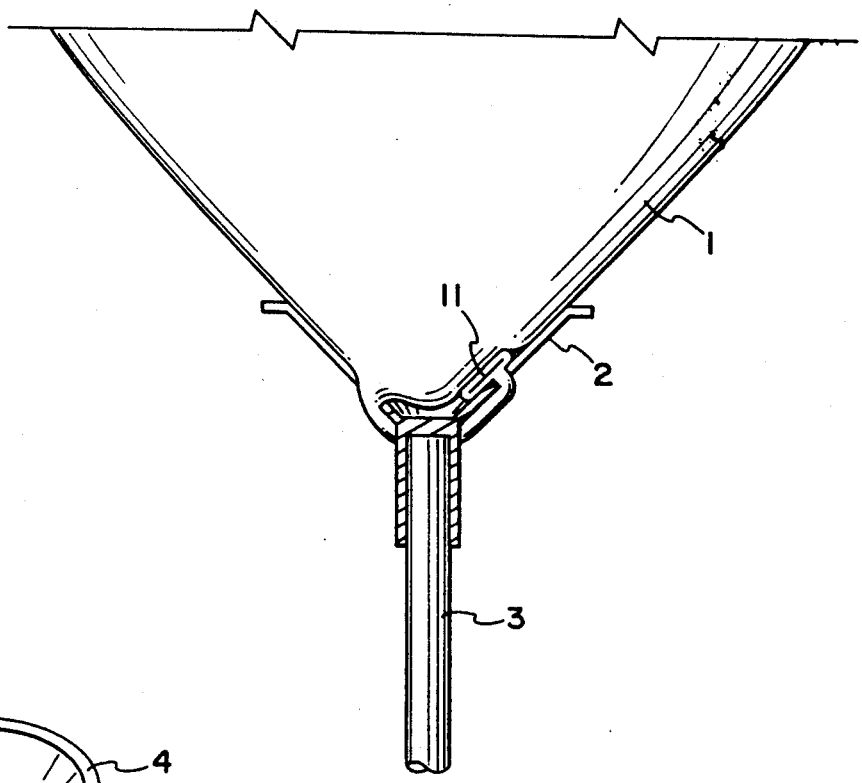
FIG. 3 (PRIOR ART)
FIG. 3 is a sectional schematic view showing the mouth of a balloon being tied on the conventional balloon holder.
Figure 4:
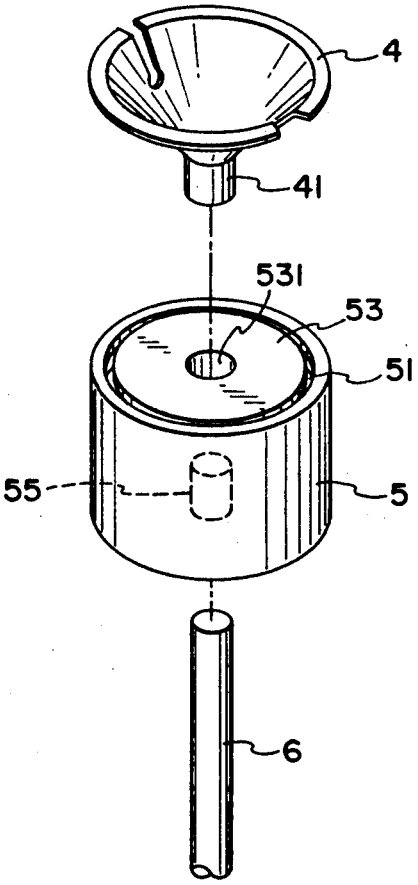
FIG. 4 is a perspective exploded view of a preferred embodiment of a balloon holder of this invention.

Referring to FIG. 4, a balloon holder of this invention includes a shank 6 and a bracket plate 4 having two notches 42 for positioning a mouth of a balloon and a stud 41 extending from a side thereof, which have a structure similar to the conventional shank and a bracket plate of a balloon holder. A hollow casing 5 made of an insulative material is connected between the bracket plate 4 and the shank 6. The shank 6 is inserted into a cavity 55 formed in the bottom of the casing 5.

Figure 5:
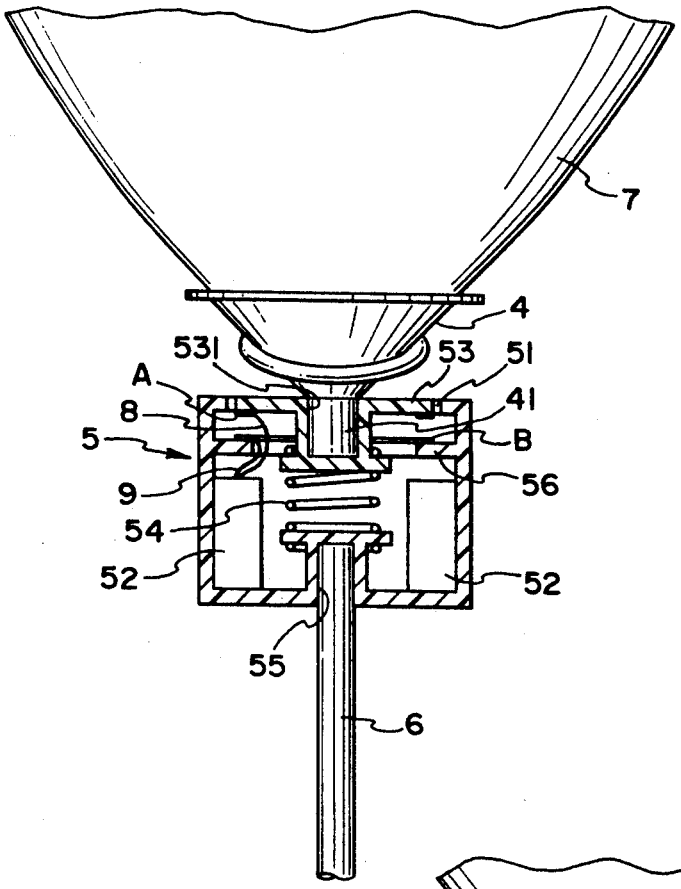
FIG. 5 is a sectional schematic view showing the a balloon being attached to the balloon holder of this invention.
Figure 6:
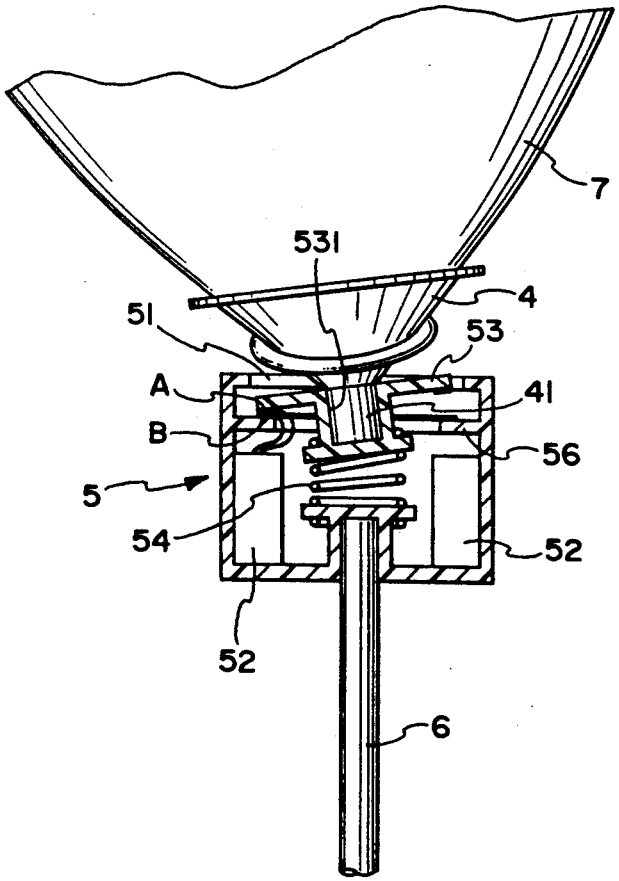
FIG. 6 is a sectional schematic view showing the balloon holder of this invention in an operative position.

Referring to FIG. 5, the casing 5 has an electronic music producing device 52, a spring member 54 and a swinging plate 53 mounted therein. The swinging plate 53 is connected between the bracket plate 4 and the spring member 54 and is located at a top opening 51 of the casing 5. The stud 41 of the bracket plate 4 is inserted into a cavity 531 formed in the center of the top face of the swinging plate 53. The spring member 54 is connected between the bottom of the casing and the swinging plate 53 so that the swinging plate 53 can swing within the casing 5. An annular flange 56 extends inwardly from the internal wall of the casing 5 between the swing plate 53 and the electronic music producing device 52. A first and a second electrically conductive ring (A, B) are respectively provided on the swinging plate 53 and the annular flange 56 and are respectively and electrically connected to the electronic music producing device 52 by means of two wires 8 and 9. Therefore, the electronic music producing device 52 can be actuated to produce music when the swinging plate 54 is swung to allow the first and second electrically conductive rings (A, B) to contact by shaking the shank 6 and/or the balloon 7 attached to the bracket plate 4, as best illustrated in FIG. 6.

It is noted that, in this embodiment, the swinging plate 53 and the bracket plate 4 are detachable, as are the shank 6 and the casing 5. Therefore, the casing 5 can be used with the conventional balloon holder to enhance the amusing effects thereof. However, the swinging plate and the bracket plate of this invention may be integrally formed with each other.

With this invention thus explained, it is apparent that numerous modifications and variations can be made without departing from the scope and spirit of this invention. It is therefore intended that this invention be limited only as indicated in the appended claims.

I claim:

1. A balloon holder comprising:

a bracket plate having two notches for positioning a mouth of a balloon and a stud extending from a side thereof;

a hollow casing made of an insulative material and having an electronic music producing device, a spring member and a swinging plate mounted therein, said swinging plate being connected to said stud of said bracket plate at one side thereof and to said spring member at the other side thereof, said spring member being connected to a bottom of said casing at one end thereof and to said other side of said swinging plate at the other end thereof so that said swinging plate can swing within said casing, an annular flange extending inwardly from an internal wall of said casing between said swing plate and said electronic music producing device, said swinging plate having a first electrically conductive ring connected thereto and said annular flange having a second electronically conductive ring connected thereto, said first and second electrically conductive rings being respectively and electrically connected to said electronic music producing device, said electronic music producing device being actuated to produce music when said swinging plate is swung to allow said first and second electrically conductive rings to contact; and a shank having one end connected to said casing.

* * * * *